US012612748B2

(12) United States Patent
Shao et al.

(10) Patent No.: US 12,612,748 B2
(45) Date of Patent: Apr. 28, 2026

(54) COMPOSITE CAPPING BEAM WITH STEEL BEAM AND ULTRA-HIGH-PERFORMANCE CONCRETE PLATE AND CONSTRUCTION METHOD THEREFOR

(71) Applicant: HUNAN UNIVERSITY, Changsha (CN)

(72) Inventors: Xudong Shao, Changsha (CN); Huaqiao Zeng, Changsha (CN); Minghong Qiu, Changsha (CN)

(73) Assignee: HUNAN UNIVERSITY, Changsha (CN)

( * ) Notice: Subject to any disclaimer, the term of this patent is extended or adjusted under 35 U.S.C. 154(b) by 227 days.

(21) Appl. No.: 18/344,994

(22) Filed: Jun. 30, 2023

(65) Prior Publication Data

US 2023/0349114 A1 Nov. 2, 2023

Related U.S. Application Data

(63) Continuation of application No. PCT/CN2022/103298, filed on Jul. 1, 2022.

(30) Foreign Application Priority Data

Mar. 21, 2022 (CN) ..... 202210275910.5

(51) Int. Cl.
*E01D 19/00* (2006.01)
*E01D 101/26* (2006.01)

(52) U.S. Cl.
CPC ..... *E01D 19/005* (2013.01); *E01D 2101/268* (2013.01)

(58) Field of Classification Search
CPC .. E04C 3/293; E04C 3/294; E04C 2003/0413; E04C 3/29; E04B 1/30; E04B 5/29
See application file for complete search history.

(56) References Cited

U.S. PATENT DOCUMENTS 3,694,990 A * 10/1972 Pamer ..... E04C 3/06 29/463
4,196,558 A * 4/1980 Jungbluth ..... E04C 3/293 52/340

(Continued)

FOREIGN PATENT DOCUMENTS

CN 204715195 U 10/2015
CN 109024907 A 12/2018

(Continued)

*Primary Examiner* — Brian E Glessner
*Assistant Examiner* — Daniel J Kenny
(74) *Attorney, Agent, or Firm* — Nitin Kaushik

(57) ABSTRACT

Disclosed is a composite capping beam with a steel beam and an ultra-high-performance concrete plate. The composite capping beam includes a steel beam and an ultra-high-performance concrete (UHPC) plate, where the steel beam includes a bottom plate and web plates, the web plates are arranged at two sides of the bottom plate in a longitudinal bridge direction, bottoms of the web plates extend downwards to be provided with lower extension sections, and the UHPC plate is clamped in a cavity defined by the lower extension sections and the bottom plate. The present disclosure further provides a construction method for the composite capping beam with a steel beam and an ultra-high-performance concrete plate. The composite capping beam with a steel beam and an ultra-high-performance concrete plate according to the present disclosure is small in hoisting weight and economical.

7 Claims, 6 Drawing Sheets

(56) References Cited

U.S. PATENT DOCUMENTS

| | | | | |
|---|---|---|---|---|
| 7,107,730 | B2 * | 9/2006 | Park | E04C 5/08 52/841 |
| 8,621,797 | B2 * | 1/2014 | Kim | E04C 5/162 52/223.8 |
| 10,597,864 | B1 * | 3/2020 | Pearson | E04B 5/40 |
| 2009/0313937 | A1 * | 12/2009 | Zureick | E04C 3/06 52/742.14 |

FOREIGN PATENT DOCUMENTS

| | | | |
|---|---|---|---|
| CN | 218436581 | U | 2/2023 |
| KR | 20220124513 | * | 3/2021 |

* cited by examiner

COMPOSITE CAPPING BEAM WITH STEEL BEAM AND ULTRA-HIGH-PERFORMANCE CONCRETE PLATE AND CONSTRUCTION METHOD THEREFOR

CROSS-REFERENCE TO RELATED APPLICATIONS

The application claims priority to Chinese patent application No. 202210275910.5, filed on Mar. 21, 2022, the entire contents of which are incorporated herein by reference.

TECHNICAL FIELD

The present disclosure belongs to the technical field of bridge engineering, and particularly relates to a capping beam and a construction method therefor.

BACKGROUND

A bridge pier and abutment structure is an important part of a bridge structure. A capping beam in the bridge pier and abutment structure plays a connecting role by transferring upper loads to a lower structure and foundation. The loads include a dead load and a live load borne by an upper structure. When the capping beam is designed, there are various influence factors to be considered, such as an upper bridge structure span, a bridge width, a vehicle load, and traffic under a bridge. This means that unique design and construction of the capping beam is of key significance for buildup of the bridge.

With the continuous development of urbanization in China, increasing bridge engineers have paid attention to rational use of space under urban overpasses. A large cantilever capping beam structure can make full use of urban space and save land. Meanwhile, it can create attractive appearance and broad vision, and thus well satisfy needs of urbanization.

A construction method for the large cantilever capping beam structure can be mainly divided into two types: on-site pouring and prefabricated assembly. When a huge beam body is constructed through on-site pouring, a series of complicated procedures are required to be completed. They include support and form erection, steel mesh binding, pouring and curing, and multi-times prestress tensioning. Prefabricated assembly is a trend of transformation and upgrading of construction industries and development of strategic industries in China. This method can upgrade the entire construction industry. Further, it can reduce labor intensity, save energy and protect an environment, and make products economical and durable. At present, common capping beam structures fully prefabricated mainly include a fully prefabricated prestressed concrete capping beam and a fully prefabricated steel capping beam. The fully prefabricated prestressed concrete capping beam has a great beam height (a ratio of the height of the capping beam to a cantilever length is generally greater than 1/4). It has a low use ratio of space under the bridge and a hoisting weight over 500 tons. In general, it needs to be hoisted in stages and assembled on site and undergo prestress tensioning in batches, resulting in complicated construction. The fully prefabricated steel capping beam has a small hoisting weight and a small beam height. However, a steel structure has high cost. Moreover, two materials at a steel-concrete transition joint between the steel capping beam and a concrete pier have different stiffness, and are stressed in a complex way, which is likely to become a defect of a structural system.

A steel-concrete composite structure refers to a structural form in which different materials are used in the same section. In this structure, respective material performance advantages of steel and concrete are fully exerted through rational mechanical distribution. A large cantilever capping beam has main mechanical characteristics of high tensile and compressive stress caused by the upper structure. High-strength steel over 420 MPa can withstand high tensile stress. Ultra-high-performance concrete (UHPC) has a high compressive strength. Under the same pressure, cost of the UHPC is about 40% of that of the steel. In view of that, a novel assembled capping beam is provided by combining the high-strength steel with the UHPC. It can effectively reduce a structure weight and a beam height, and is highly economical. Therefore, it has a desirable application prospect in a rapid construction technology of assembled bridges and long-span bridge structures.

SUMMARY

An objective of the present disclosure is to overcome shortcomings and defects mentioned in the above background, and provide a composite capping beam with a steel beam and an ultra-high-performance concrete plate and a construction method therefor. The composite capping beam is small in weight, convenient to construct, great in beam height, and desirable in mechanical performance. In order to achieve the above objective, the present disclosure provides the following technical solutions:

A composite capping beam with a steel beam and an ultra-high-performance concrete plate includes a steel beam and an ultra-high-performance concrete (UHPC) plate (a solid plate), where the steel beam includes a bottom plate and web plates, the web plates are arranged at two sides of the bottom plate in a longitudinal bridge direction, bottoms of the web plates extend downwards to be provided with lower extension sections, and the UHPC plate is clamped in a cavity defined by the lower extension sections and the bottom plate. The web plates are seamlessly fixed to the two sides of the bottom plate in the longitudinal bridge direction, such that a bottom surface of the cavity and two sides in the longitudinal bridge direction are in a sealed state, so as to be conducive to later pouring of the UHPC plate.

In the composite capping beam with a steel beam and an ultra-high-performance concrete plate, preferably, a thickness of the UHPC plate does not exceed 1/5 of a height of the composite capping beam (including a height of the lower extension sections). The thickness of the UHPC plate is determined by considering many factors. Too small a thickness may make checking computation of structural indexes (such as checking computation of stress) unable to satisfy specification requirements, while too great a thickness may cause cost waste, increase a hoisting weight of a structure, and reduce cost performance of the structure. In the present disclosure, the UHPC plate used has a small thickness, which does not exceed 1/5 of the height of the composite capping beam. A neutral axis of a section is easily controlled at a position higher than the UHPC plate, such that the entire section of the UHPC plate bears pressure, the UHPC plate may bear large compressive stress, and further compressive performance of ultra-high-performance concrete is fully exerted. Meanwhile, a hoisting weight of the composite capping beam is greatly reduced, and the entire composite capping beam is low in cost, small in weight, and high in cost performance.

In the composite capping beam with a steel beam and an ultra-high-performance concrete plate, preferably, a height of the lower extension sections (that is, a vertical height) is equal to the thickness of the UHPC plate. Through the above arrangement, it is ensured that a depth of the cavity defined by the lower extension sections and the bottom plate is equal to the thickness of the UHPC plate, and that a beam height of the top steel beam is equal to a total beam height of the section of the composite capping beam. Shear bearing capacity of the web plates is closely related to an area of sections of the web plates in the longitudinal bridge direction. If no lower extension sections are provided, a height of the steel web plates mainly bearing a structural shear force may decrease, and the beam height of the capping beam or a thickness of the web plates need to be appropriately increased to satisfy shear requirements. The increase in the beam height of the capping beam limits application of a capping beam structure in urban bridges, and the increase in the thickness of the web plates is not conducive to welding construction and welding quality control during welding. In the present disclosure, the shear-resistant steel web plates are arranged in the capping beam from bottom to top (that is, the lower extension sections are arranged), such that the height of the shear-resistant web plates is increased. The lower extension sections may be fully used to reduce the total height of the capping beam and the thickness of the web plates, which is conducive to welding. If the lower extension sections has a small height, stress requirements can be hardly satisfied, the thickness of the web plates needs to be increased, and the lower extension sections can hardly be used as forms for pouring of the UHPC plate. If the height of the lower extension sections increases, the thickness of the corresponding steel web plates may be appropriately reduced, but further, the total height of the capping beam may increase accordingly, and a use ratio of space under a bridge may decrease, which is not conducive to popularization and application of the structure. On the whole, it is more preferable to control the height of the lower extension sections to be equal to the thickness of the UHPC plate.

In the composite capping beam with a steel beam and an ultra-high-performance concrete plate, preferably, the bottom plate and the lower extension sections are provided with a plurality of shear connectors (for example, cheese head studs) and the UHPC plate is fixedly arranged in the cavity defined by the lower extension sections and the bottom plate by means of the shear connectors. The bottom plate at a compression side of the steel beam is connected to a top surface of the UHPC plate by means of the shear connectors, such that stability of the compression side of the steel beam may be greatly improved. In the present disclosure, the bottom plate is connected on a section of the composite capping beam (that is, the bottom plate completely connects the web plates at the two sides without disconnection in the middle). Such arrangement provides enough space for arrangement of the shear connectors configured to connect the UHPC plate and the bottom plate, such that the top steel beam is connected to the solid UHPC plate more sufficiently and reliably, which is more conducive to improvement in stability of the compression side of the steel beam.

In the composite capping beam with a steel beam and an ultra-high-performance concrete plate, preferably, the steel beam is of a variable section structure, and a section gradually expands in a direction from a cantilever end to a center of the composite capping beam and then becomes a uniform section; and a height of an end of the steel beam is 1200 mm-1500 mm, and a height of a central part is 1/6-1/4.5 of a length of a cantilever of the composite capping beam.

In the composite capping beam with a steel beam and an ultra-high-performance concrete plate, preferably, the UHPC plate is of a variable section structure, and a section gradually expands in a direction from a cantilever end to a center of the composite capping beam and then becomes a uniform section; and a thickness of an end of the UHPC plate is 150 mm-250 mm, and a thickness of a central part is 400 mm-500 mm.

In the present disclosure, the composite capping beam uses a large cantilever structure. When the capping beam structure bears a load transmitted from an upper structure through a support, stress borne by the structure gradually increases from the cantilever end to the central part. Therefore, the composite capping beam of the present disclosure uses the variable section structure having a height gradually increasing from the cantilever end to the central part.

In the composite capping beam with a steel beam and an ultra-high-performance concrete plate, preferably, the steel beam further includes a top plate, the top plate is arranged on a top of the web plates, the top plate is provided with a plurality of transverse-bridge stiffening ribs arranged in a transverse bridge direction, the web plate is provided with a plurality of vertical stiffening ribs arranged vertically at intervals, and a plurality of diaphragms vertically arranged are arranged between the top plate, the web plates and the bottom plate at intervals.

In the composite capping beam with a steel beam and an ultra-high-performance concrete plate, preferably, the top plate has a thickness of 30 mm-70 mm, the web plates have a thickness of 14 mm-25 mm, the bottom plate has a thickness of 16 mm-20 mm, the transverse-bridge stiffening ribs have a thickness of 20 mm-30 mm, the vertical stiffening ribs have a thickness of 20 mm-24 mm, the diaphragms have a thickness of 16 mm-20 mm, an interval between the adjacent transverse-bridge stiffening ribs is 1000 mm-1300 mm, and an interval between the adjacent vertical stiffening ribs and an interval between the adjacent diaphragms are both 2000 mm-2400 mm. The steel beam is made of steel having a strength grade of Q420 or above. In this way, the beam height of the composite capping beam is easier to control, and the composite capping beam is more economical.

In the composite capping beam with a steel beam and an ultra-high-performance concrete plate, preferably, the top plate is provided with the support configured to bear the load of the upper structure.

As an entire technical concept, the present disclosure further provides a construction method for the composite capping beam with a steel beam and an ultra-high-performance concrete plate. The construction method includes the following steps:

S1: pre-assembling and forming a steel beam, where when the steel beam is formed, lower extension sections and a bottom plate are fixedly provided with shear connectors; and

S2: controlling an opening of a cavity defined by the lower extension sections and the bottom plate to be upward, pouring UHPC into the cavity, and conducting curing to obtain an UHPC plate, that is, prefabricating the composite capping beam with a steel beam and an ultra-high-performance concrete plate.

In the construction method, preferably, in S2, a pier-beam splicing part is formed through pouring while the UHPC is poured, a form is mounted before the pier-beam splicing part is formed through pouring, a pier-column connector is pre-embedded, and the form is demolished and curing is conducted after pouring is completed.

In the construction method, specifically, prefabrication and subsequent mounting construction include the following steps:

S1: completing prefabrication work of the composite capping beam with a steel beam and an ultra-high-performance concrete plate in a factory, which specifically includes the following steps:

S1.1: welding the shear connectors onto web plates and the bottom plate according to design requirements;

S1.2: welding a top plate, the web plates, the bottom plate, transverse-bridge stiffening ribs, vertical stiffening ribs and diaphragms in the factory, and conducting assembly to form the steel beam;

S1.3: overturning the steel beam to enable the opening of the cavity formed by the web plates and the bottom plate to face upwards, binding steel bars according to the design requirements, erecting the form above the opening of the cavity (so as to be configured to synchronously form the pier-beam splicing part through pouring), pre-embedding the pier-column connector, then pouring the ultra-high-performance concrete, and conducting steam curing; and

S1.4: demolishing and properly storing the form after a strength of the ultra-high-performance concrete satisfies the design requirements, that is, completing fabrication of a prefabricated unit of the composite capping beam with a steel beam and an ultra-high-performance concrete plate;

S2, transporting the composite capping beam unit prefabricated in S1 to a construction site, and conducting hoisting and mounting, so as to form pier-column connection; and

S3: mounting a support on a top plate of the steel beam after structure curing according to the design requirements, that is, completing prefabrication and construction.

In the construction method, preferably, a volume fraction of steel fibers of the ultra-high-performance concrete configured for pouring of the UHPC plate may be 1.5%, and economic benefits may be improved by reducing the volume fraction of steel fibers. Preferably, the ultra-high-performance concrete having a compressive strength not lower than 140 MPa is selected and a micro-expanding agent is added, so as to control shrinkage. In this way, tight connection of composite sections is ensured while compressive performance requirements of the UHPC plate are ensured.

The present disclosure uses a composite structure with high-strength steel and the ultra-high-performance concrete, and makes full use of excellent tensile strength of the high-strength steel and excellent compressive strength of the ultra-high-performance concrete. The high-strength steel and the ultra-high-performance concrete are combined to obtain a composite capping beam structure with a high-strength steel beam and an ultra-high-performance concrete plate. In the present disclosure, the lower extension sections are arranged to increase the height of the shear-resistant web plates, the lower extension sections may be fully used to reduce the total height of the composite capping beam and control the thickness of the web plates, and the lower extension sections may further be used as the form during pouring of the UHPC plate. In the present disclosure, the bottom plate of the composite capping beam with a steel beam and ultra-high-performance concrete completely connects the web plates at the two sides. Such arrangement provides enough space for arrangement of the shear connectors configured to connect the UHPC plate and the bottom plate. In this way, the steel beam is connected to the UHPC plate more sufficiently and reliably. Moreover, the UHPC plate is fully and reliably connected to the compressed bottom plate, so as to fully ensure stability of the compression side of the steel beam, such that the steel beam may better exert tensile performance. In the present disclosure, the UHPC plate formed by pouring the ultra-high-performance concrete is completely controlled in a compression zone of the composite section, such that compressive performance of the ultra-high-performance concrete is fully exerted. Meanwhile, the hoisting weight of the composite capping beam is greatly reduced, such that the composite capping beam is small in weight and high in strength, may easily control the beam height, and may better adapt to height limit requirements of urban bridges. On the whole, the composite capping beam with a steel beam and an ultra-high-performance concrete plate according to the present disclosure is small in hoisting weight and economical, can easily control the beam height, has guaranteed bearing capability and rigidity satisfying requirements, and is quick and reliable to assemble and construct.

Compared with the prior art, the present disclosure has the following advantages:

1. The composite capping beam with a steel beam and an ultra-high-performance concrete plate according to the present disclosure makes full use of the excellent tensile performance of steel and the excellent compressive performance of the ultra-high-performance concrete, and the UHPC plate formed by pouring the ultra-high-performance concrete ensures stability of the compression side of the steel beam, such that the steel beam can better exert the tensile performance. The steel and the ultra-high-performance concrete complement each other, such that the hoisting weight of the composite capping beam is greatly reduced, and the beam height required for designing the composite capping beam is reduced. In this way, the composite capping beam can better adapt to the height limit requirements of urban bridges, and a design effect of the small weight and high strength can be achieved. Through preliminary estimation, the hoisting weight of a large cantilever capping beam for six lanes is only about 120 tons.
2. The composite capping beam with a steel beam and an ultra-high-performance concrete plate according to the present disclosure clamps the UHPC plate in the cavity defined by the lower extension sections and the bottom plate. The lower extension sections are arranged to be conducive to reliable connection between the UHPC plate and the steel beam. Moreover, the lower extension sections are arranged to increase the height of the shear-resistant web plates. The lower extension sections can be fully used to reduce the total height of the composite capping beam and control the thickness of the web plates, which is conducive to welding construction and can improve welding quality.
3. During pouring construction of the composite capping beam with a steel beam and an ultra-high-performance concrete plate according to the present disclosure, the lower extension sections of the web plates and the bottom plate can be used as forms, such that complicated forms are prevented from being erected during prefabrication construction, and rapid and efficient prefabrication is achieved.
4. The composite capping beam with a steel beam and an ultra-high-performance concrete plate according to the present disclosure selects the high-strength steel, which can bear large tensile stress of an upper edge of a large cantilever capping beam, and further can reduce the beam height. In this way, better economical and use effects are obtained. In addition, the capping beam is located under the upper structure, so as to avoid sun and rain, such that durability of the steel can be ensured more easily, and the composite capping beam has lower whole life maintenance cost than an all-concrete capping beam structure.

5. A construction process and a construction device for the composite capping beam with a steel beam and an ultra-high-performance concrete plate according to the present disclosure are mature, such that no cost for new personnel training, device updating, etc. is required, and the construction method is simple and convenient.

BRIEF DESCRIPTION OF DRAWINGS

To describe the technical solutions in examples of the present disclosure or in the prior art more clearly, the accompanying drawings required for describing the examples or the prior art will be briefly described below. Apparently, the accompanying drawings in the following description show some embodiments of the present disclosure, and a person of ordinary skill in the art may still derive other drawings from these accompanying drawings without creative efforts.

REFERENCE NUMERALS

Figure 1:
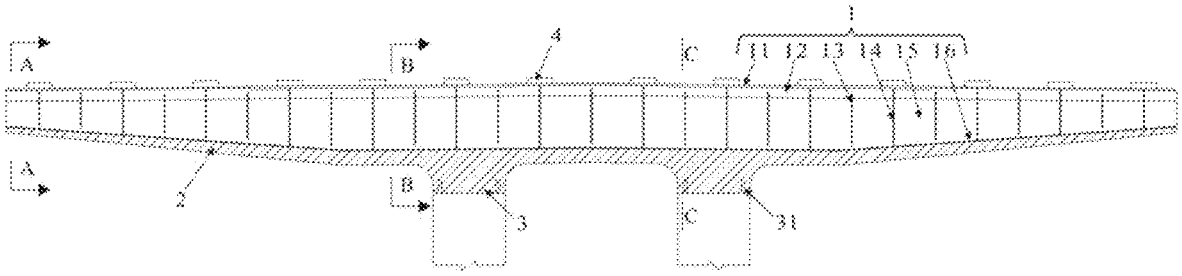
FIG. 1 is a structural diagram of a front view of a composite capping beam with a steel beam and an ultra-high-performance concrete plate in Embodiment 1.
Figure 2:
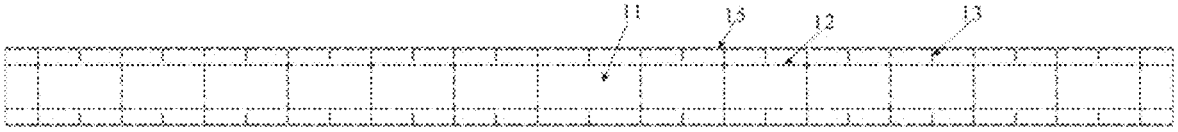
FIG. 2 is a top plan view of a composite capping beam with a steel beam and an ultra-high-performance concrete plate in Embodiment 1.
Figure 3:
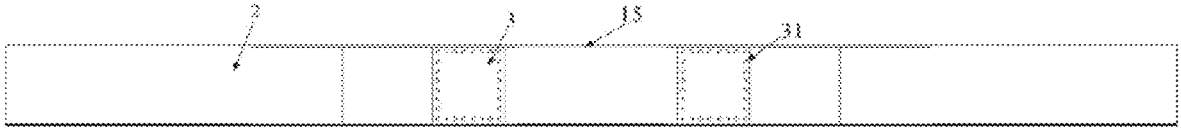
FIG. 3 is a bottom plan view of a composite capping beam with a steel beam and an ultra-high-performance concrete plate in Embodiment 1.

1, steel beam; 11, top plate; 12, transverse-bridge stiffening rib; 13, vertical stiffening rib; 14, diaphragm; 15, web plate; 151, lower extension section; 16, bottom plate; 2, UHPC plate; 3, pier-beam splicing part; 31, pier-column connector; 4, support; and 5, shear connector.

DETAILED DESCRIPTION OF THE EMBODIMENTS

In order to facilitate understanding of the present disclosure, the present disclosure is described in detail below in conjunction with the accompanying drawings of the description and the preferred embodiments, but the protection scope of the present disclosure is not limited to the following specific embodiments.

Unless otherwise defined, all technical terms used hereinafter have the same meaning as commonly understood by those skilled in the art. The technical terms used herein are merely for the purpose of describing specific embodiments, and are not intended to limit the protection scope of the present disclosure.

Unless otherwise specified, various raw materials, reagents, instruments, devices, etc. used in the present disclosure can be purchased from the market or can be prepared by existing methods.

EMBODIMENT

As shown in FIGS. 1-6, a composite capping beam with a steel beam and an ultra-high-performance concrete plate according to the embodiment includes a steel beam 1 and an ultra-high-performance concrete UHPC plate 2. The steel beam 1 includes a bottom plate 16 and web plates 15. The web plates 15 are arranged at two sides of the bottom plate 16 in a longitudinal bridge direction, and bottoms of the web plates 15 extend downwards to be provided with lower extension sections 151. The UHPC plate 2 is clamped in a cavity defined by the lower extension sections 151 and the bottom plate 16. The web plates 15 are seamlessly fixed to the two sides of the bottom plate 16 in the longitudinal bridge direction, such that a bottom surface of the cavity and two sides in the longitudinal bridge direction are in a sealed state, so as to be conducive to later pouring of the UHPC plate 2. In addition, the UHPC plate 2 obtained through pouring is a solid plate, and is fixedly connected to the steel beam 1 into a whole.

In the embodiment, a thickness of the UHPC plate 2 does not exceed 1/5 of a height of the composite capping beam.

In the embodiment, a height of the lower extension sections 151 is equal to a thickness of the UHPC plate 2.

Figure 4:
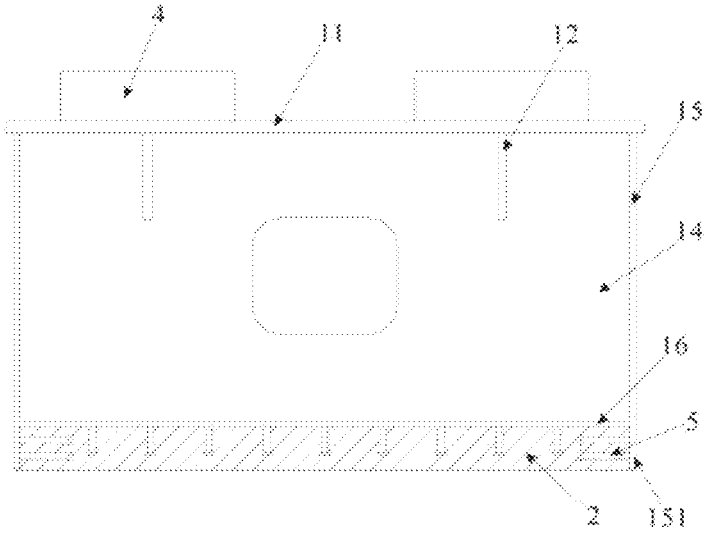
FIG. 4 is a sectional view along A-A in FIG. 1.
Figure 5:
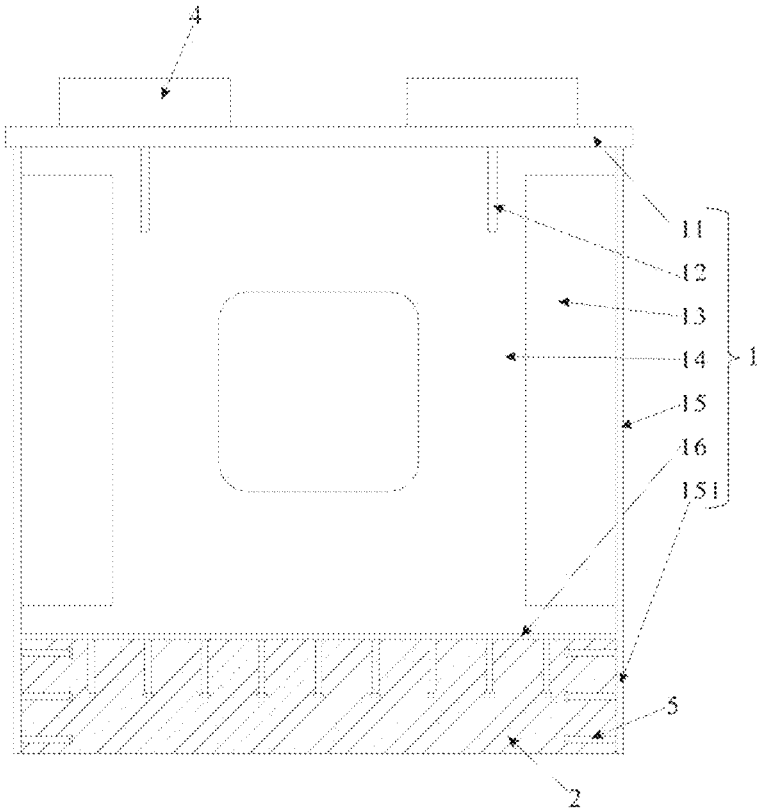
FIG. 5 is a sectional view along B-B in FIG. 1.
Figure 6:
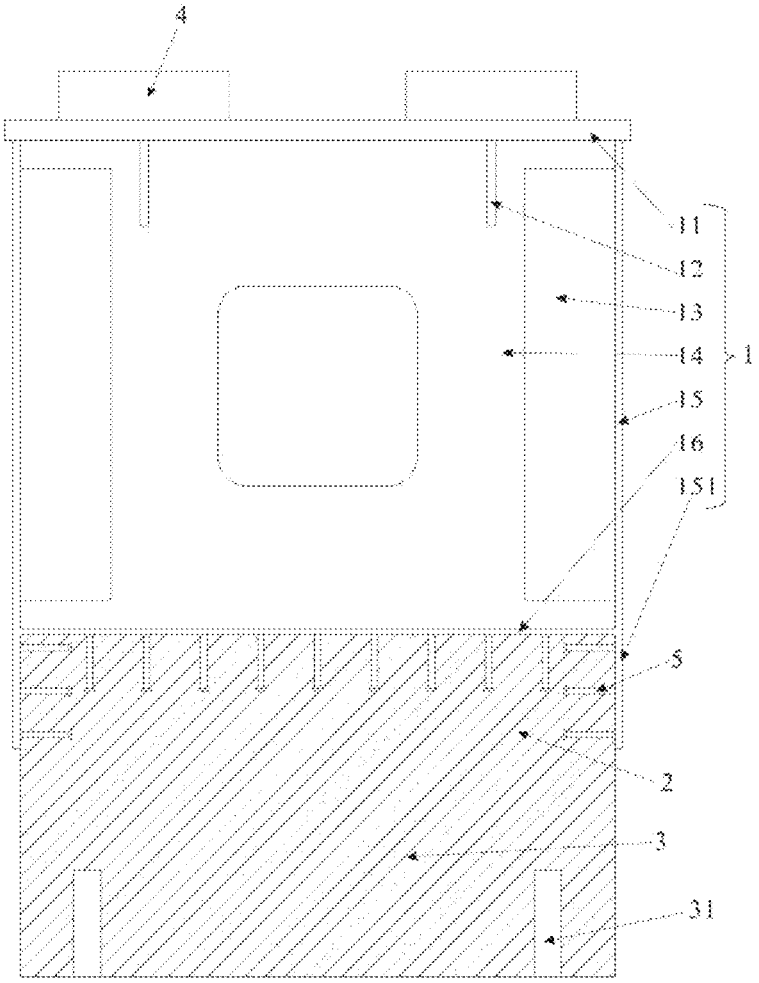
FIG. 6 is a sectional view along C-C in FIG. 1.

As shown in FIGS. 4-6, in the embodiment, the bottom plate 16 and the lower extension sections 151 are provided with a plurality of shear connectors 5, and the UHPC plate 2 is fixedly arranged in the cavity defined by the lower extension sections 151 and the bottom plate 16 by means of the shear connectors 5. Cheese head studs may be used as the shear connectors 5.

In the embodiment, the steel beam 1 is of a variable section structure, and a section gradually expands in a direction from a cantilever end to a center of the composite capping beam and then becomes a uniform section. A height of an end of the steel beam 1 is 1200 mm-1500 mm (for example, may be 1200 mm), and a height of a central part is 1/6-1/4.5 of a length of a cantilever of the composite capping beam (for example, may be 2200 mm).

In the embodiment, the UHPC plate 2 is of a variable section structure, and a section gradually expands in a direction from a cantilever end to a center of the composite capping beam and then becomes a uniform section. A thickness of an end of the UHPC plate 2 is 150 mm-250 mm (for example, may be 150 mm), and a thickness of a central part is 400 mm-500 mm (for example, may be 400 mm).

In the embodiment, the steel beam 1 further includes a top plate 11, the top plate 11 is arranged on a top of the web plates 15, the top plate 11 is provided with a plurality of transverse-bridge stiffening ribs 12 arranged in a transverse bridge direction, the web plate 15 is provided with a plurality of vertical stiffening ribs 13 arranged vertically at intervals, and a plurality of diaphragms 14 vertically arranged are arranged between the top plate 11, the web plates 15 and the bottom plate 16 at intervals.

In the embodiment, the top plate 11 has a thickness of 30 mm-70 mm (for example, may be 30 mm, 50 mm, or 40 mm), the web plates 15 have a thickness of 14 mm-25 mm (for example, may be 16 mm, 18 mm, or 14 mm), the bottom plate 16 has a thickness of 16 mm-20 mm (for example, may be 16 mm or 20 mm), the transverse-bridge stiffening ribs 12 have a thickness of 20 mm-30 mm (for example, may be 20 mm), the vertical stiffening ribs 13 have a thickness of 20 mm-24 mm (for example, may be 20 mm), the diaphragms 14 have a thickness of 16 mm-20 mm (for example, may be 16 mm), an interval between the adjacent transverse-bridge stiffening ribs 12 is 1000 mm-1300 mm (for example, may be 1220 mm), and an interval between the adjacent vertical stiffening ribs 13 and an interval between the adjacent diaphragms 14 are both 2000 mm-2400 mm (for example, may both be 2315 mm). The steel beam 1 is made of steel having a strength grade of Q420 or above.

In the embodiment, the top plate 11 is provided with a support 4 configured to bear a load of an upper structure.

In the embodiment, a volume fraction of steel fibers of ultra-high-performance concrete configured for pouring may be 1.5%. The ultra-high-performance concrete having a compressive strength of 140 MPa is selected and an expanding agent is added, so as to control shrinkage. In this way, tight connection of composite sections is ensured while compressive performance requirements of the UHPC plate 2 are ensured.

In the embodiment, the UHPC plate 2 formed by pouring the ultra-high-performance concrete is completely controlled in a compression zone of the composite section, such that compressive performance of the ultra-high-performance concrete is fully exerted, and the composite capping beam is small in weight and high in strength, may easily control a beam height, and may better adapt to height limit requirements of urban bridges.

A prefabrication and construction method for the composite capping beam with a steel beam and an ultra-high-performance concrete plate according to the embodiment includes the following steps:

S1: prefabrication work of the composite capping beam with a steel beam and an ultra-high-performance concrete plate is completed in a factory, and specific steps are as follows:

S1.1: shear connectors 5 are welded onto web plates 15 and a bottom plate 16 according to design requirements;

S1.2: a top plate 11, transverse-bridge stiffening ribs 12, vertical stiffening ribs 13, diaphragms 14, the web plates 15 and the bottom plate 16 are welded in the factory, and assembly is conducted to form a steel beam 1;

S1.3: the steel beam 1 is overturned to enable an opening of a cavity formed by the web plates 15 and the bottom plate 16 to face upwards, steel bars are bound according to the design requirements, a form is erected above the opening of the cavity so as to be configured to form a pier-beam splicing part 3 through pouring, a pier-column connector 31 is pre-embedded, then ultra-high-performance concrete is poured, and steam curing is conducted; and S1.4: the form is demolished and properly stored after a strength of the ultra-high-performance concrete satisfies the design requirements, that is, fabrication of a prefabricated unit of the composite capping beam with a steel beam and an ultra-high-performance concrete plate is completed.

S2: the composite capping beam unit prefabricated in S1 is transported to a construction site, and hoisting and mounting are conducted, so as to form pier-column connection.

S3: a support 4 is mounted on the top plate 11 after structure curing according to the design requirements, that is, prefabrication and mounting construction of the composite capping beam with a steel beam and an ultra-high-performance concrete plate are completed.

What is claimed is:

1. A composite capping beam comprising:

a steel beam (1), and a high compressive strength concrete plate (2), wherein the steel beam (1) comprises a bottom plate (16) and web plates (15), the web plates (15) arranged at two sides of the bottom plate (16) in a longitudinal direction, lower extension sections (151) extend downwards from the bottoms of the web plates (15), and the high compressive strength concrete plate (2) is held in a cavity defined by the lower extension sections (151) and the bottom plate (16);

wherein a thickness of the high compressive strength concrete plate (2) is less than 1/5 of a height of the composite capping beam.

2. The composite capping beam according to claim 1, wherein a height of the lower extension sections (151) is equal to a thickness of the high compressive strength concrete plate (2).

3. The composite capping beam according to claim 1, wherein a plurality of shear connectors (5) are arranged at the bottom plate (16) and the lower extension sections (151), and the high compressive strength concrete plate (2) is fixedly arranged in the cavity defined by the lower extension sections (151) and the bottom plate (16) by means of the shear connectors (5).

4. The composite capping beam according to claim 1, wherein the steel beam (1) is of a variable section structure, a section of the steel beam (1) gradually expands in a direction from a cantilever end to a center of the composite capping beam and then becomes a uniform section; and a height of an end of the steel beam (1) is 1200 mm-1500 mm, and a height of a central part of the steel beam (1) is 1/6-1/4.5 of a length of a cantilever of the composite capping beam.

5. The composite capping beam according to claim 1, wherein the high compressive strength concrete plate (2) is of a variable section structure, and a section of the high compressive strength concrete plate (2) gradually expands in a direction from a cantilever end to a center of the composite capping beam and then becomes a uniform section; and a thickness of an end of the high compressive strength concrete plate (2) is 150 mm-250 mm, and a thickness of a central part of the high compressive strength concrete plate (2) is 400 mm-500 mm.

6. The composite capping beam according to claim 1, wherein the steel beam (1) further comprises a top plate (11), the top plate (11) is arranged on a top of the web plates (15), the top plate (11) is provided with a plurality of transverse stiffening ribs (12) arranged in a transverse direction, the web plate (15) is provided with a plurality of vertical stiffening ribs (13) arranged vertically at intervals, and a plurality of diaphragms (14) are vertically arranged between the top plate (11), the web plates (15) and the bottom plate (16) at intervals.

7. The composite capping beam according to claim 6, wherein the top plate (11) has a thickness of 30 mm-70 mm, the web plates (15) have a thickness of 14 mm-25 mm, the bottom plate (16) has a thickness of 16 mm-20 mm, the transverse stiffening ribs (12) have a thickness of 20 mm-30 mm, the vertical stiffening ribs (13) have a thickness of 20 mm-24 mm, the diaphragms (14) have a thickness of 16 mm-20 mm, an interval between the adjacent transverse stiffening ribs (12) is 1000 mm-1300 mm, and an interval between the adjacent vertical stiffening ribs (13) and an interval between the adjacent diaphragms (14) are both 2000 mm-2400 mm; and the steel beam (1) is made of steel having a strength grade of Q420 or above.

* * * * *